United States Patent [19]

Rogers, Jr.

[11] Patent Number: 4,917,420

[45] Date of Patent: Apr. 17, 1990

[54] LOW EFFORT CABLE RELEASE HOOD LATCH ASSEMBLY

[75] Inventor: Lloyd W. Rogers, Jr., Utica, Mich.

[73] Assignee: General Motors Corporation, Detroit, Mich.

[21] Appl. No.: 312,269

[22] Filed: Feb. 21, 1989

[51] Int. Cl.[4] ..... F05C 3/26

[52] U.S. Cl. ..... 292/198; 292/216; 292/DIG. 43; 292/DIG. 14

[58] Field of Search ..... 292/216, DIG. 23, DIG. 43, 292/196, 198, 210, DIG. 25, DIG. 14

[56] References Cited

U.S. PATENT DOCUMENTS

| | | | |
|---|---|---|---|
| 3,365,226 | 1/1968 | Shay | 292/216 |
| 3,692,343 | 9/1972 | Meyer | 292/216 |
| 3,785,186 | 1/1974 | James et al. | 292/216 X |
| 3,985,381 | 10/1976 | Kobayashi | 292/216 |
| 4,202,571 | 5/1980 | Nishikoori | 292/216 |
| 4,203,621 | 5/1980 | Noel et al. | 292/216 |
| 4,783,102 | 11/1988 | Bernard | 292/216 |

FOREIGN PATENT DOCUMENTS

| | | | |
|---|---|---|---|
| 1114924 | 5/1968 | United Kingdom | 292/216 |

*Primary Examiner*—Eric K. Nicholson

*Attorney, Agent, or Firm*—William A. Schuetz

[57] ABSTRACT

A hood latch assembly for latching and unlatching a hood for an automotive vehicle comprises a housing for receiving a striker on the hood, a locking lever spring biased toward an unlatched position in which it releases the striker, but movable to a latched position in reponse to the hood being closed, a detent lever for holding the locking lever in its latched position, a cable release and a release lever disposed between the detent lever and locking lever. The release lever is connected to the cable release and engages the detent lever to provide a high mechanical advantage to the detent lever, when actuated to release the hood, to reduce hood opening effort and the locking lever automatically returns the release lever and cable release to their original positions when moved to its unlatched position whereby no spring return for the cable release is required.

4 Claims, 1 Drawing Sheet

LOW EFFORT CABLE RELEASE HOOD LATCH ASSEMBLY

The present invention relates to a hood latch assembly and, more particularly, to a low effort cable release hood latch assembly.

Heretofore, the assignee of the present invention has manufactured hood latch assemblies for latching and unlatching a hood of an automotive vehicle to its associated vehicle body structure. These latch assemblies have included a housing which is mounted to the body structure of the vehicle adjacent one end of the hood and which receives a striker carried by the hood, a slotted locking or fork bolt lever pivotally supported by the housing and biased toward an unlatched position in which it releases the striker, but which is movable to a latched position in response to the striker being received in the slot to cam the locking lever to a latched position in which a hook end portion thereof overlies the striker when the hood is being moved to a closed position, a detent lever pivotally supported by the housing and spring biased toward a first or locking position in which it holds the locking lever in its latched position and a manually manipulatable release means comprising a cable which is connected at one end to the detent lever and at its other end to a spring biased handle or lever adjacent the dashboard of the vehicle. By pulling on the handle, the detent lever is pivoted to a release position in which it releases the locking lever for movement toward its unlatched position to release the striker and allow the hood to be opened. The handle, upon being released, is returned to its original position adjacent the dashboard by a compression spring operatively associated with the cable release means and which was compressed during the pulling of the handle to release the detent lever.

While the above-described hood latch assemblies have been highly successful in operation, the cable release means does require a predetermined amount of pull force to be manually applied thereto in order to sufficiently compress the compression spring and effect movement of the detent lever to its release position.

Accordingly, it is broad object of the present invention to provide a new and improved hood latch assembly of the type described above, but which requires only a low effort to release the detent lever when the manually operable cable release is pulled and which automatically restores the cable release to its original position upon it being released without the need for a return compression spring operatively associated with the cable release means.

Another object of the present invention is to provide a new and improved hood latch assembly, as defined in the next preceding object, and wherein the hood latch assembly includes a release or force multiplier lever operatively connected to the cable release and disposed between the locking and detent levers, and in which the release lever, when initially moved in response to manually pulling of the cable release, provides a high mechanical advantage to the detent lever to cause the latter to be moved to its release position with a low effort and in which the locking lever, as it pivots to its unlatching position, engages the release lever and causes the same and the cable release to be returned to their original position as well as thereafter block movement of the release lever while the locking lever remains in its unlatched position.

Advantages of the present invention are that, even though a release lever is added to the hood latch assembly, the hood latch assembly is still of a compact and economical construction in that it eliminates the need for a cable release return spring and associated bracketry at the dashboard to return the cable release to its original position. This results in a more economical overall construction as well as a substantial reduction in the amount of force or effort needed to operate the cable release to release the detent lever.

The present invention further resides in various novel constructions and arrangement of parts, and further objects, novel characteristics and advantages of the present invention will be apparent to those skilled in the art to which it relates and from the following detailed description of the illustrated, preferred embodiment thereof made with reference to the accompanying drawings forming a part of this specification and in which similar reference numerals are employed to designate corresponding parts throughout the several views, and in which.

Figure 1:
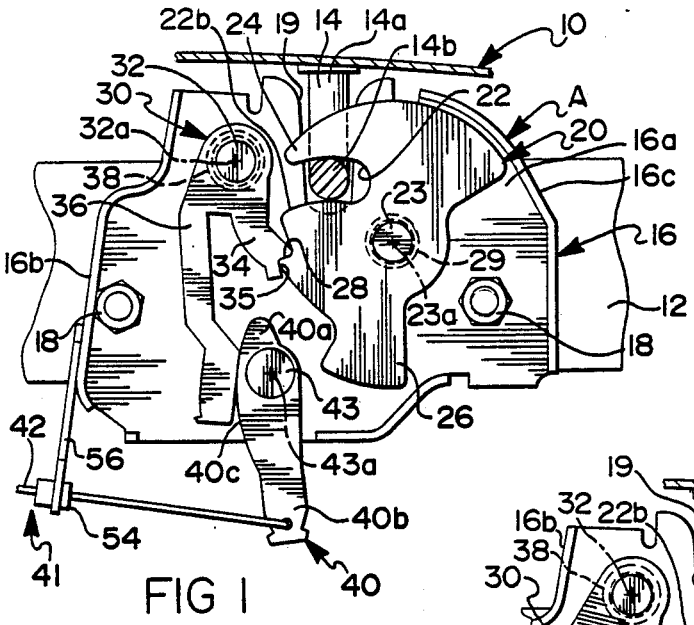
FIG. 1 is a front elevational view of the novel hood latch assembly of the present invention, and showing the parts thereof in their position for latching the hood of an automotive vehicle in its closed position.

The present invention provides a novel hood latch assembly A for latching and unlatching a hood 10 of an automotive vehicle (not shown) to its associate vehicle body structure 12. The hood 10 carries on its underside a striker 14. The striker 14 extends vertically downwardly and comprises a generally U-shaped member having a circular cross section. The striker 14 includes a pair of spaced vertically extending legs 14*a* (only one of which is shown) and a generally horizontally disposed bight 14*b* which is adapted to be engaged by the hood latch assembly A. The hood 10 would be swingably mounted on the vehicle (not shown) for movement between an open position and a closed position, as shown in FIG. 1, in which the hood 10 would be latched by the hood latch assembly A to the vehicle body structure 12. The vehicle body structure 12 comprises a generally horizontally extending strut extending transversely of the vehicle at the front of the engine compartment (not shown) and located adjacent to the end of the hood 10 carrying the striker 14.

Figure 2:
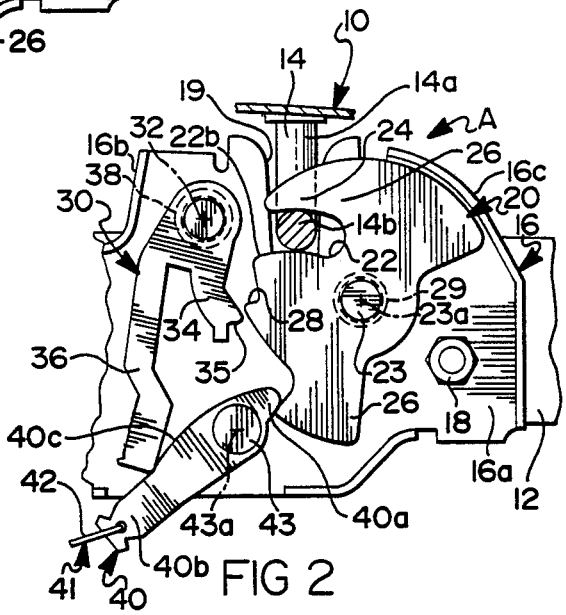
FIG. 2 is a view like that shown in FIG. 1, but showing the parts thereof in an intermediate position in which the hood of the vehicle is being unlatched.
Figure 3:
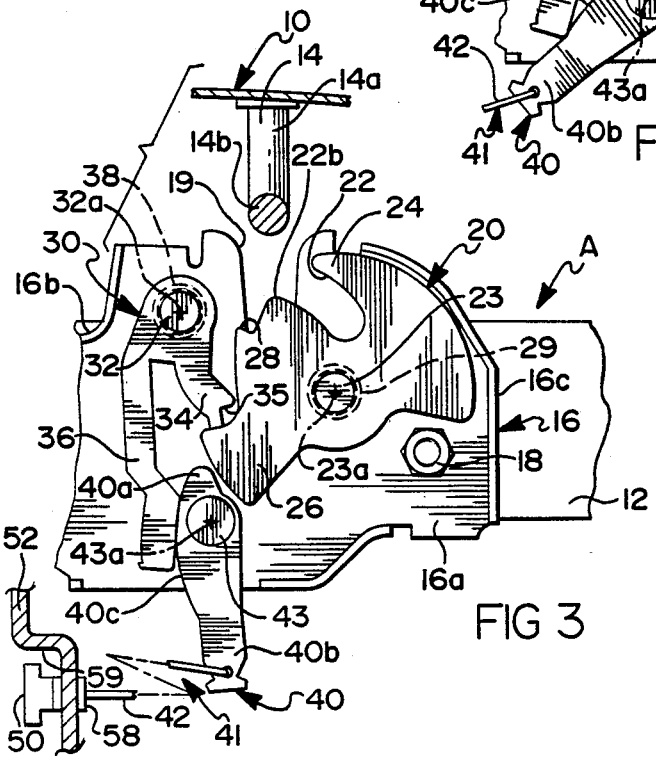
FIG. 3 is a view like that shown in FIG. 1, but showing the parts thereof in their positions in which the hood of the vehicle is unlatched from the hood latch assembly.

The hood latch assembly A comprises, in general, a housing 16 which is mounted to the body structure 12 of the vehicle adjacent the front end of the hood 10, a locking or fork bolt lever 20 pivotally supported by the housing 16 and spring biased toward an unlatched position, as shown in FIG. 3, in which it releases the striker 14, but which is movable to a latched position, as shown in FIG. 1, in response to the striker 14 being received in a slot 22 in the lever 20 and camming the locking lever 20 to a latched position in which a hook shaped end 24 thereof overlies the striker 14 when the hood 10 is being moved to a closed position, a detent lever 30 pivotally supported by the housing 16 and spring biased to a first or locking position, as shown in FIG. 1, in which it holds the locking lever 20 in its latched position and a second or release position, as shown in FIG. 2, in which it allows the locking lever 20 to be moved towards its release position, as shown in FIG. 3, a release or force multiplier lever 40 pivotally supported by the housing 16 for movement in opposite directions and which is engageable with the detent lever 30, and a manually manipulatable cable release means 41 comprising a cable 42 which is connected at one end to the release lever 40 and at its other end to a handle or lever 50 adjacent a dashboard 52 of the vehicle, as shown in FIG. 3.

The housing 16 is vertically disposed and comprises a stamped sheet metal member having a planar bottom 16*a* which is adapted to be bolted onto a vertical side of the vehicle support structure 12 via bolts 18 and a pair of generally vertically disposed side walls 16*b* and 16*c*. The housing 16 at its upper end extends above the body structure 12 and also includes a vertically extending slot 19 in its bottom wall 16*a* and which has a width greater than the width of the striker 14 so as to freely receive the striker 14.

The locking or fork bolt lever 20 is pivotally supported by the bottom wall 16*a* of the housing 16 via a pivot pin means 23 for movement in opposite directions about a horizontal axis 23*a*. The locking lever 20 comprises a one piece, generally planar member made from steel and which has an arcuately shaped transverse through slot 22 extending inwardly from its left side, as viewed in FIG. 1, for receiving the bight 14*b* of the striker 14. The locking lever 20 at its upper end 24, as viewed in FIG. 1, is hook shaped and overlies the striker 14. The hook shaped end 24 defines one side of the slot 22. The other or lower side of the slot 22 provides a cam surface 22*b* which is engageable by the bight 14*b* of the striker 14. The locking lever 20 also includes a lower depending leg or leg portion 26 and an intermediate stepped portion 28 located adjacent the detent lever 30 and below the slot 22. The locking or fork bolt lever 20 is adapted to be spring biased in a clockwise direction towards its unlatched position, as shown in FIG. 3, by a torsion spring 29 which surrounds the pivot pin means 23 and has one end in operative engagement with the lever 20 at its other end in operative engagement with the housing 16.

The detent lever 30 is pivotally supported by the housing 16 via a pivot pin means 32 for movement in opposite directions about a horizontal axis 32*a*. The detent lever 30 is bifurcated to define a first leg 34 having a stepped portion 35 at its free end which is adapted to cooperably engage the stepped portion 28 on the fork bolt lever 20 to hold it in its latched position and a second leg 36 spaced from the first leg and which is of a longer length than the first leg 34. The detent lever 30 is spring biased in a counterclockwise direction toward its first or locking position, as shown in FIG. 1, by a torsion spring 38 which surrounds the pivot means 32 and has one end in operative engagement with the housing 16 and its other end in operative engagement with the detent lever 30.

The release lever 40 is pivotally supported intermediate its upper and lower ends by the housing 16 via a pivot pin means 43 for movement in opposite directions about a generally horizontal axis 43*a*. The release lever 40 is disposed between the leg 36 of the detent lever 30 and the lower portion 26 of the locking lever 20 and comprises an arcuate or rounded upper end 40*a*, a lower end or leg 40*b* to which the cable 42 of the cable release means 41 is connected and an intermediate portion 40*c*. The intermediate portion 40*c* of the release lever 40 is arcuate or rounded and engages the lowermost side portion of the leg 36 of the detent lever 30. The locking, detent and release levers 20, 30 and 40, respectively, all lie in a common vertical plane.

The cable release means 41 comprises the cable 42 which is slidably guided by a ferrule 54 carried by a bracket 56 secured to the side wall 16*b* of the housing 16 and which is slidably received in a ferrule 58 secured to the dashboard 52. The cable 42 at its one end is suitably connected to the release lever 40 and at its other end is suitably connected to the handle 50 which is disposed within a recess 59 in the dashboard 52 adjacent the ferrule 58.

The operation of the hood latch assembly A will now be described. When the hood 10 is in its closed position and latched by the hood latch assembly A, the respective parts of the hood latch assembly A are in the position shown in FIG. 1. In this position, the locking lever 20 has its hook shaped end 24 overlying the bight 14*b* of the striker 14 and the locking lever 20 is held in this position by the detent lever 30 as a result of the engagement between the step portion 35 on the detent lever 30 and the step portion 28 on the locking lever 20.

When it is desired to release the hood 20 for movement towards its open position, the operator need merely pull on the handle 50 of the cable release means 41. Pulling on the handle 50 causes the cable 42 to be moved toward the left, as viewed in FIGS. 1 and 2, which in turn causes the release lever 40 to be pivoted in a clockwise direction. Movement of the release lever 40 in this direction causes the detent lever 30, as a result of its engagement with the release lever 40, to be pivoted in a clockwise direction in opposition to the biasing force of its biasing spring 38. When the release lever 40 has been rotated in a clockwise direction a sufficient extent to cause the detent lever 30 to release the locking lever 20, as a result of its stepped portion 35 disengaging the stepped portion 28 of the locking lever 20, as shown in FIG. 2, the locking lever 20, due to the biasing force of its torsion spring 29 is caused to be rotated in a clockwise direction, as shown in FIGS. 2 and 3, to effect release of its hook shaped end portion 24 from the bight 14*b* of the striker 14.

As the locking or latching lever 20 is pivoted in the clockwise direction by the torsion spring 29, the lower leg 26 thereof will come into engagement with the upper end portion 40*a* of the release lever 40. This will cause the release lever 40 to be pivoted in a counterclockwise direction and cause the cable release 42 and handle 50 to be returned toward their normal position, as shown in FIG. 3. The detent lever 30 at all times remains in engagement with the release lever 40 due to the biasing force of its torsion spring 38. As shown in FIG. 3, when the cable release lever 40 has been returned to its normal position, the latching lever 20 will clear the upper end 40*a* of the release lever 40 and have its lower leg portion 26 engaged with the stepped portion 35 of the detent lever 30 to prevent further clockwise pivotal movement of the locking lever 20. Moreover, when the locking lever 20 is in the position shown in FIG. 3, the lower leg 26 thereof blocks movement of the release lever 40 in a clockwise direction and thus prevents the cable release 42 from being manually operated while the hood 10 is unlatched from the latch assembly A.

It should be noted at this point that when the hood latch assembly A is released to allow the striker 14 to clear the housing 16 of the hood latch assembly A, that a conventional manually operable secondary latch and pop-up spring (not shown) could be employed in addition to the hood latch assembly A to hold the hood 10 in a partially opened position. The secondary hood latch (not shown) would be operable to engage and latch the striker 14 when it reaches an intermediate open position, such as shown in FIG. 3, and the pop-up spring (not shown) would be operatively associated with the hood 10 and vehicle support structure 12 to cause the hood 10 to be moved to this intermediate open position. These parts, however, have not been shown or described in the drawings, since they are conventional and do not form a part of the present invention.

When the hood 10 is in an open position, the hood latch assembly A has its parts thereof shown in the positions shown in FIG. 3. When the hood 10 is moved from an open position to its closed position, the striker 14 thereon will first be received in the slot 19 of the housing 16. Further downward movement of the striker 14 will cause the bight **14*b* thereof to engage the cam surface 22*b* defining the slot in the locking lever 20. Engagement between the bight 14*b* of the striker 14 and the cam surface 22*b* will cause the locking lever 20 to be pivoted in a counterclockwise direction and in opposition to the biasing force of its biasing spring 29. Movement of the locking or fork bolt lever 20 in a counterclockwise direction from its position shown in FIG. 3 towards its position shown in FIG. 2 will cause the portion thereof beneath the stepped portion 28 to cam the detent lever 30 in a clockwise direction and in opposition to the biasing force of its biasing spring 38. This movement continues until the stepped portion 28 clears the stepped portion 35 on the detent lever 30 whereupon the biasing force of the biasing spring 38 will return the detent lever 30 in a counterclockwise direction so its stepped portion 35 will be in operative locking engagement with the step portions 28 on the lock bolt lever 20 to hold the latter in its latched position, as shown in FIG. 1. Note that during this pivotal or rotational movement of the detent lever 30 by the fork bolt lever 20, the position of the release lever 40 does not change, since the leg 26 of the lever is free to move past the release lever 40 without engaging the latter. The detent lever 30 merely rotates in a clockwise direction away from the release lever 40 until locking engagement occurs between the stepped portion 35 and the stepped portion 28 on the locking lever 20**.

An important advantage in the addition of the release lever 40 to the hood latch assembly A is that the release lever 40 acts as a force multiplier to provide a high mechanical advantage to the detent lever 30 when it is moved from its first or locking position to its second or release position, as shown in FIG. 2. The engagement between the portion **40*c* of the release lever 40 and the leg 36 of the detent lever 30, due to the relative position of their pivots 43 and 32, respectively, and their relative lengths allow a high force to be applied to the detent lever 30 with only a low effort on the part of the operator in manually pulling on the cable release 42. Also, the addition of the release lever 40 and its relative position with respect to the locking lever 20 is such that it is automatically returned to its original position by the locking lever 20. This eliminates the need for a compression spring and bracket adjacent the dashboard for the cable release means 41** to return the latter to its original position. This provides a hood latch assembly A which is both economical and which can be manually manipulated with a low effort as compared to conventional hood latches which employ return compression springs.

Although the latch assembly A has been described for use as a hood latch assembly, it will, of course, be understood that the same latch assembly could be employed in conjunction with other vehicle closure panels, such as deck lids, tailgates, etc.

Although the illustrated embodiment thereof has been described in great detail, it should be apparent that certain modifications, changes and adaptations may be made in the illustrated embodiment, and that it is intended to cover all such modifications, changes and adaptations which come within the spirit of the present invention.

The embodiments of the invention in which an exclusive property or privilege is claimed are defined as follows:

1. A latch assembly for latching and unlatching a pivotally movable closure panel of an automotive vehicle comprising a housing which is adapted to be mounted to vehicle body structure of the vehicle adjacent a striker on the closure panel, a locking lever pivotally supported by said housing for movement between a latched position in which an upper end portion thereof is latched to the striker on said closure panel to hold the latter in its closed position and an unlatched position in which said upper end portion releases the striker to allow the closure panel to be moved toward an open position, said locking lever being biased toward said unlatched position and having a lower end portion remote from its upper end portion, a detent lever pivotally supported by said housing for movement between a first position in which a first portion thereof engages said locking lever to retain the latter in its latched position and a second position in which said first portion thereof releases said locking lever to allow the latter to be moved to its unlatched position, said detent lever having a second portion and being spring biased toward its first position, and manually manipulatable release means operatively associated with said second portion of said detent lever for moving the latter in opposition to its spring biasing force from its first position toward its second position to release said locking lever for movement toward its unlatched position, the improvement being that said latch assembly includes a third lever pivotally supported by said housing and at least partially located between said lower end portion of said locking lever and said second portion of said detent lever, said third lever having an upper end disposed within the path of movement of said lower end portion of said locking lever, a lower end which is connected with said manually manipulatable release means and an intermediate portion adjacent its pivot which engages said second portion of said detent lever, said third lever in response to being rotated in one direction by manual movement of said manually manipulatable release means in a first direction exerting a high mechanical advantage to said detent lever and causing the latter to be rotated from its first position toward its second position to release said locking lever for movement from its latched position toward its unlatched position to release the striker, said lower portion of said locking lever engaging said upper end of said third lever as it moves towards its unlatched position to cam and return said third lever and release means back toward its original position and then blocking said third lever against movement in said one direction while the closure panel is open, said locking lever being adapted to be engaged by said striker and cammed from its unlatched position toward its latched position when the closure is being moved toward its closed position, said locking lever during this movement also camming said detent lever against its spring bias toward its second position until the first portion thereof is aligned with a detent portion on said locking lever whereupon said spring biased detent lever returns to its first position to detentably engage and hold said locking lever in its latched position.

2. A hood latch assembly for latching and unlatching a pivotally movable hood of an automotive vehicle comprising a housing which is adapted to be mounted to vehicle body structure of the vehicle adjacent a striker on the hood, a locking lever pivotally supported by said housing for movement between a latched position in which an upper end portion thereof is latched to the striker on said hood to hold the latter in its closed position and an unlatched position in which said upper end portion releases the striker to allow the hood to be moved toward an open position, said locking lever being biased toward said unlatched position and having a lower end portion remote from its upper end portion, a detent lever pivotally supported by said housing for movement between a first position in which a first portion thereof engages said locking lever to retain the latter in its latched position and a second position in which said first portion thereof releases said locking lever to allow the latter to be moved to its unlatched position, said detent lever having a second portion and being spring biased toward its first position, and manually manipulatable release means operatively associated with said second portion of said detent lever for moving the latter in opposition to its spring biasing force from its first position toward its second position to release said locking lever for movement toward its unlatched position, the improvement being that said latch assembly includes a third lever pivotally supported by said housing and at least partially located between said lower end portion of said locking lever and said second portion of said detent lever, said third lever having an upper end disposed within the path of movement of said lower end portion of said locking lever, a lower end which is connected with said manually manipulatable release means and an intermediate portion adjacent its pivot which engages said second portion of said detent lever, said third lever in response to being rotated in one direction by manual movement of said manually manipulatable release means in a first direction exerting a high mechanical advantage to said detent lever and causing the latter to be rotated from its first position toward its second position to release said locking lever for movement from its latched position toward its unlatched position to release the striker, said lower portion of said locking lever engaging said upper end of said third lever as it moves towards its unlatched position to cam and return said third lever and release means back toward its original position and then blocking said third lever against movement in said one direction while said hood is open, said locking lever being adapted to be engaged by said striker and cammed from its unlatched position toward its latched position when the hood is being moved toward its closed position, said locking lever during this movement also camming said detent lever against its spring bias toward its second position until the first portion thereof is aligned with a detent portion on said locking lever whereupon said spring biased detent lever returns to its first position to detentably engage and hold said locking lever in its latched position.

3. A latch assembly, as defined in claim 2, and wherein said third lever is pivotally supported intermediate its ends, has a rounded upper end portion and an intermediate portion for engaging said second portion of said detent lever which is arcuate in shape to rollably engage said second portion of said detent lever.

4. A latch assembly, as defined in claim 3, and wherein said detent lever is bifurcated to define said first and second leg portions, and wherein said intermediate portion of said third lever engages said second leg portion of said detent lever at its free end.

* * * * *